US011486343B2

(12) United States Patent
Suzuki et al.

(10) Patent No.: US 11,486,343 B2
(45) Date of Patent: Nov. 1, 2022

(54) ELECTROMAGNETIC FUEL INJECTION VALVE

(71) Applicant: HITACHI ASTEMO, LTD., Hitachinaka (JP)

(72) Inventors: Yuya Suzuki, Hitachinaka (JP); Norihide Ouchi, Hitachinaka (JP); Nozomu Sasaki, Hitachinaka (JP); Junpei Kogawa, Hitachinaka (JP); Sho Kanda, Hitachinaka (JP)

(73) Assignee: Hitachi Astemo, Ltd., Ibaraki (JP)

( * ) Notice: Subject to any disclaimer, the term of this patent is extended or adjusted under 35 U.S.C. 154(b) by 0 days.

(21) Appl. No.: 17/545,328

(22) Filed: Dec. 8, 2021

(65) Prior Publication Data

US 2022/0298996 A1 Sep. 22, 2022

(30) Foreign Application Priority Data

Mar. 22, 2021 (JP) ..... JP2021-047944

(51) Int. Cl.
*F02M 51/06* (2006.01)

(52) U.S. Cl.
CPC ..... *F02M 51/061* (2013.01)

(58) Field of Classification Search
CPC ..... F02M 51/061
See application file for complete search history.

(56) References Cited

U.S. PATENT DOCUMENTS

2007/0272773 A1* 11/2007 Akabane ..... F02M 61/168 239/585.1
2008/0035761 A1* 2/2008 Akabane ..... F02M 61/16 29/890.142
2017/0145974 A1* 5/2017 Yasuda ..... F02M 63/0075
2021/0088015 A1 3/2021 Nabeshima et al.

FOREIGN PATENT DOCUMENTS

JP 6788085 B1 11/2020

* cited by examiner

*Primary Examiner* — Lindsay M Low
*Assistant Examiner* — Arnold Castro
(74) *Attorney, Agent, or Firm* — Carrier Blackman & Associates, P.C.; Joseph P. Carrier; William D. Blackman

(57) ABSTRACT

In an electromagnetic fuel injection valve, a plurality of recess parts are provided in an attracted face of a movable core, the recess parts dividing a taper face of the movable core into a plurality of sections along a peripheral direction of the movable core. Accordingly, a fuel oil film present in an engaged part between an annular projection of a fixed core and the taper face is sectioned at a plurality of locations, thereby suppressing a sticking phenomenon of the engaged part caused by the fuel oil film. Therefore, when energization of a coil is cut off, a delay in detachment of the movable core from the fixed core is eliminated, thus contributing to improvement of valve-closing responsiveness.

4 Claims, 5 Drawing Sheets

VALVE-OPEN STATE

VALVE-CLOSED STATE

VALVE-OPEN STATE

ELECTROMAGNETIC FUEL INJECTION VALVE

CROSS REFERENCE TO RELATED APPLICATIONS

The present application claims priority under 35 U.S.C. § 119 to Japanese Patent Application No. 2021-47944 filed Mar. 22, 2021 the entire contents of which are hereby incorporated by reference.

BACKGROUND OF THE INVENTION

Field of the Invention

The present invention relates to an electromagnetic fuel injection valve mainly used for a fuel supply system of an internal combustion engine, and particularly relates to an improvement of an electromagnetic fuel injection valve comprising a valve housing that has a valve seat in one end part thereof, a hollow fixed core that is connected to another end of the valve housing, a coil that is disposed on an outer periphery of the fixed core, a valve body that is formed by a valve part and a rod connected to the valve part that operates in cooperation with the valve seat, a movable core that is fitted around an outer periphery of the rod while making an attracted face of the movable core oppose an attracting face of the fixed core within the valve housing, a valve open-side stopper that is fixed to the rod and is pushed by the movable core so as to open the valve body when the movable core is attracted by the fixed core due to energization of the coil, a valve closed-side stopper that is fixed to the rod at a position closer to the valve seat side than the valve open-side stopper, a valve spring that urges the valve body in a valve-closing direction, and an auxiliary spring that exhibits a spring force to move the movable core away from the valve open-side stopper and make the movable core abut against the valve closed-side stopper when the coil is unenergized, an annular projection that is concentric with the fixed core being formed on the attracting face of the fixed core, and a taper face being formed on the attracted face of the movable core, the taper face being inclined downward in going toward a radially outward direction of the movable core, being coaxial with the movable core, and engaging with the annular projection when the movable core is attracted by the fixed core.

Description of the Related Art

Such an electromagnetic fuel injection valve is known as disclosed in Japanese Patent No. 6788085.

In such an electromagnetic fuel injection valve, when the coil is energized, due to engagement between an annular projection on an attracting face of the fixed core and a taper face on an attracted face of the movable core, the movable core is subjected to a self-centering action; this immediately suppresses disturbance (swing, lateral runout, etc.) of the movable core and also maintains the movable core at a position in which it is coaxial with the fixed core, thus keeping good valve-opening responsiveness for the valve body.

In such an electromagnetic fuel injection valve, since the engagement between the annular projection and the taper face is carried out over the entire periphery without interruption, due to a sticking phenomenon because of a fuel oil film present in the engaged part, when energization of the coil is cut off a delay occurs in detachment of the movable core from the fixed core, and this is one of the causes of degradation of the valve-closing responsiveness.

SUMMARY OF THE INVENTION

The present invention has been accomplished in light of such circumstances, and it is an object thereof to provide an electromagnetic fuel injection valve that can suppress the phenomenon of sticking of an engaged part between the annular projection and the taper face due to a fuel oil film present in the engaged part, can eliminate a delay in detachment of the movable core from the fixed core when energization of the coil is cut off, and can maintain good valve-closing responsiveness.

In order to achieve the object, according to a first aspect of the present invention, there is provided an electromagnetic fuel injection valve comprising a valve housing that has a valve seat in one end part thereof, a hollow fixed core that is connected to another end of the valve housing, a coil that is disposed on an outer periphery of the fixed core, a valve body that is formed by a valve part and a rod connected to the valve part that operates in cooperation with the valve seat, a movable core that is fitted around an outer periphery of the rod while making an attracted face of the movable core oppose an attracting face of the fixed core within the valve housing, a valve open-side stopper that is fixed to the rod and is pushed by the movable core so as to open the valve body when the movable core is attracted by the fixed core due to energization of the coil, a valve closed-side stopper that is fixed to the rod at a position closer to the valve seat side than the valve open-side stopper, a valve spring that urges the valve body in a valve-closing direction, and an auxiliary spring that exhibits a spring force to move the movable core away from the valve open-side stopper and make the movable core abut against the valve closed-side stopper when the coil is unenergized, an annular projection that is concentric with the fixed core being formed on the attracting face of the fixed core, and a taper face being formed on the attracted face of the movable core, the taper face being inclined downward in going toward a radially outward direction of the movable core, being coaxial with the movable core, and engaging with the annular projection when the movable core is attracted by the fixed core, wherein a plurality of recess parts are provided in the attracted face, the plurality of recess parts dividing the taper face into a plurality of sections along a peripheral direction of the movable core.

In accordance with the first aspect of the present invention, since the taper face, which engages with the annular projection when the coil is energized, is divided into a plurality of sections arranged along the peripheral direction of the movable core by means of the plurality of recess parts, a fuel oil film present in the engaged part between the annular projection and the taper face is sectioned at a plurality of locations along the peripheral direction of the movable core. This enables the sticking phenomenon of the engaged part caused by the fuel oil film to be suppressed. It is therefore possible to make the movable core move away from the fixed core immediately when energization of the coil is cut off, thus contributing to improvement of the valve-closing responsiveness.

Furthermore, the taper face being divided into a plurality of sections means a reduction in the area via which the annular projection and the taper face are engaged. This decreases the residual magnetism between the fixed core and the movable core when energization of the coil is cut off, thus further improving the valve-closing responsiveness.

According to a second aspect of the present invention, in addition to the first aspect, three of the recess parts are set so as to divide the taper face into three sections that are arranged at equal intervals along the peripheral direction of the movable core.

In accordance with the second aspect of the present invention, in addition to the first aspect, due to the taper face being divided into three sections arranged at equal intervals in the peripheral direction of the movable core by means of three recess parts, the taper face can engage with the annular projection in a stable three-point support state, and it is therefore possible to stabilize the self-centering action between the annular projection and the taper face.

According to a third aspect of the present invention, in addition to the first or second aspect, a flat face that is surrounded by the taper face and can abut against the valve open-side stopper is provided on the attracted face of the movable core, and the flat face and the taper face are covered by a plating layer that is harder than the movable core.

In accordance with the third aspect of the present invention, since the flat face, which is surrounded by the taper face and can abut against the valve open-side stopper, is provided on the attracted face of the movable core, and the flat face and the taper face are covered by the plating layer, which is harder than the movable core, it is possible to prevent as much as possible wear of the movable core caused by abutment with each of the valve open-side stopper and the annular projection, thus enabling an improvement in the durability of the fuel injection valve to be achieved.

The above and other objects, characteristics and advantages of the present invention will be clear from detailed descriptions of the preferred embodiment which will be provided below while referring to the attached drawings.

DESCRIPTION OF THE PREFERRED EMBODIMENT

An embodiment of the present invention is explained by reference to the attached FIG. 1 to FIG. 5.

Figure 1:
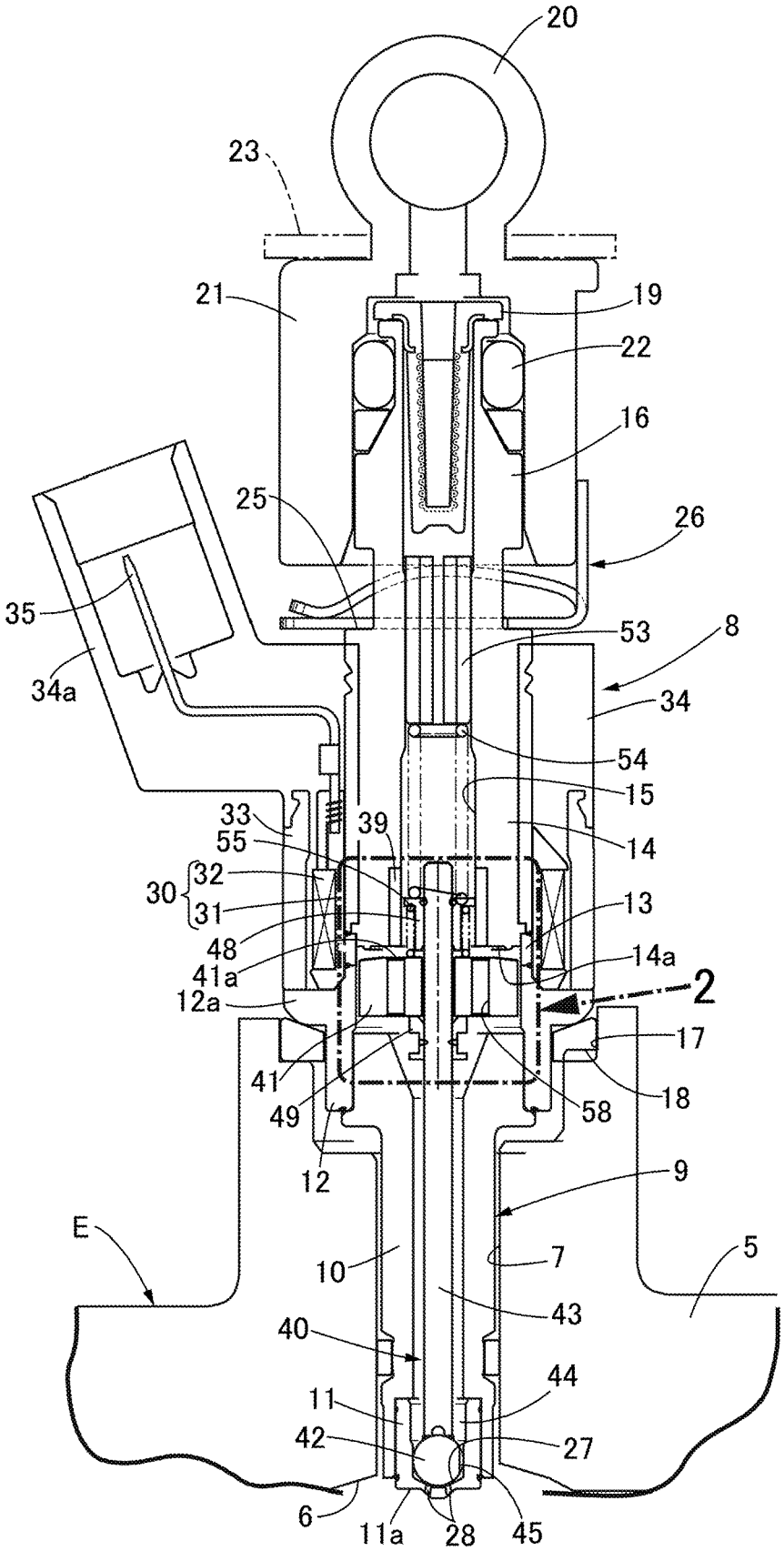
FIG. 1 is a longitudinal sectional view showing an embodiment of an electromagnetic fuel injection valve for an internal combustion engine related to the present invention.
Figure 2:
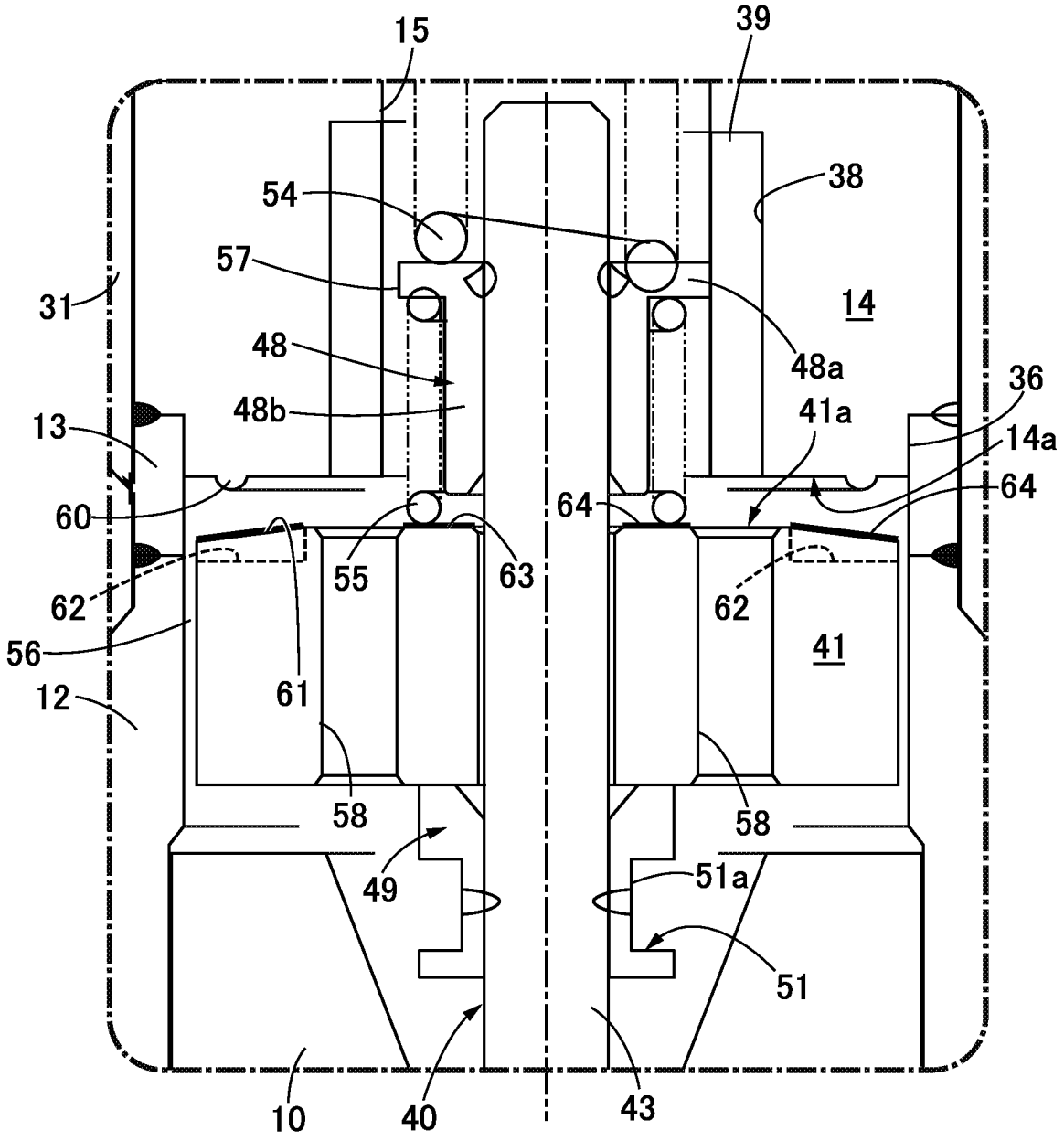
FIG. 2 is an enlarged sectional view of part shown by arrow 2 in FIG. 1 showing a valve-closed state of the fuel injection valve.

First, in FIG. 1 and FIG. 2, a cylinder head 5 of an internal combustion engine E is provided with a fitting hole 7 opening in a combustion chamber 6, and an electromagnetic fuel injection valve 8 that can inject fuel toward the combustion chamber 6 is fitted into the fitting hole 7.

A valve housing 9 of the electromagnetic fuel injection valve 8 is formed from a hollow cylindrical housing body 10, a valve seat member 11 fitted into and welded to the inner periphery of one end part of the housing body 10, a magnetic cylindrical body 12 having one end part fitted onto the outer periphery of the other end part of the housing body 10 and welded to the housing body 10, and a non-magnetic cylindrical body 13 having one end part coaxially joined to the other end part of the magnetic cylindrical body 12. One end part of a fixed core 14 having a hollow part 15 is coaxially joined to the other end part of the non-magnetic cylindrical body 13, and a fuel supply tube 16 communicating with the hollow part 15 is integrally and coaxially provided on the other end part of the fixed core 14.

The magnetic cylindrical body 12 integrally has a flange-shaped yoke portion 12*a* in an intermediate part in the axial direction thereof, and a cushion material 18 housed in an annular recess 17 provided in the cylinder head 5 so as to surround the outer end of the fitting hole 7 is disposed between the cylinder head 5 and the yoke portion 12*a*.

A fuel filter 19 is fitted into a fuel inlet provided on one end part of the fuel supply tube 16, and the fuel supply tube 16 is fitted, via an annular seal member 22, into a fuel supply cap 21 provided on a fuel distribution pipe 20. A bracket 23 is latched onto an apex part of the fuel supply cap 21, and the bracket 23 is detachably fastened by appropriate fixing means (for example, a bolt) to a support post that is risingly provided on the cylinder head 5 and is not illustrated.

An elastic member 26, which is formed from a plate spring, is disposed between the fuel supply cap 21 and an annular step part 25 provided on an intermediate part of the fuel supply tube 16 and facing the fuel supply cap 21 side. The fuel supply tube 16, that is, the electromagnetic fuel injection valve 8, is clamped between the cylinder head 5 and the elastic member 26 by means of the resilient force exhibited by this elastic member 26.

The valve seat member 11 is formed into a bottomed cylindrical shape having an end wall portion 11*a* on one end part, a conical valve seat 27 is formed on the end wall portion 11*a*, and a plurality of fuel discharge holes 28 are provided in the end wall portion 11*a* so as to open in the vicinity of the center of the valve seat 27. This valve seat member 11 is fitted into and welded to one end part of the housing body 10 so that the fuel discharge hole 28 opens toward the combustion chamber 6. That is, the valve housing 9 is formed so as to have the valve seat 27 on the one end part thereof.

A coil assembly 30 is fitted onto an outer peripheral face from the other end part of the magnetic cylindrical body 12 to the fixed core 14. This coil assembly 30 is formed from a bobbin 31 fitted onto the outer peripheral face and a coil 32 wound around the bobbin 31, and one end part of a coil housing 33 as a magnetic body surrounding the coil assembly 30 is joined to the magnetic cylindrical body 12.

The outer periphery of the other end part of the fixed core 14 is covered with a cover layer 34, made of a synthetic resin, molded so as to be connected to the other end part of the coil housing 33, and a coupler 34*a* for retaining a terminal 35 connected to the coil 32 is formed integrally with the cover layer 34 so as to project toward one side of the electromagnetic fuel injection valve 8.

Figure 3:
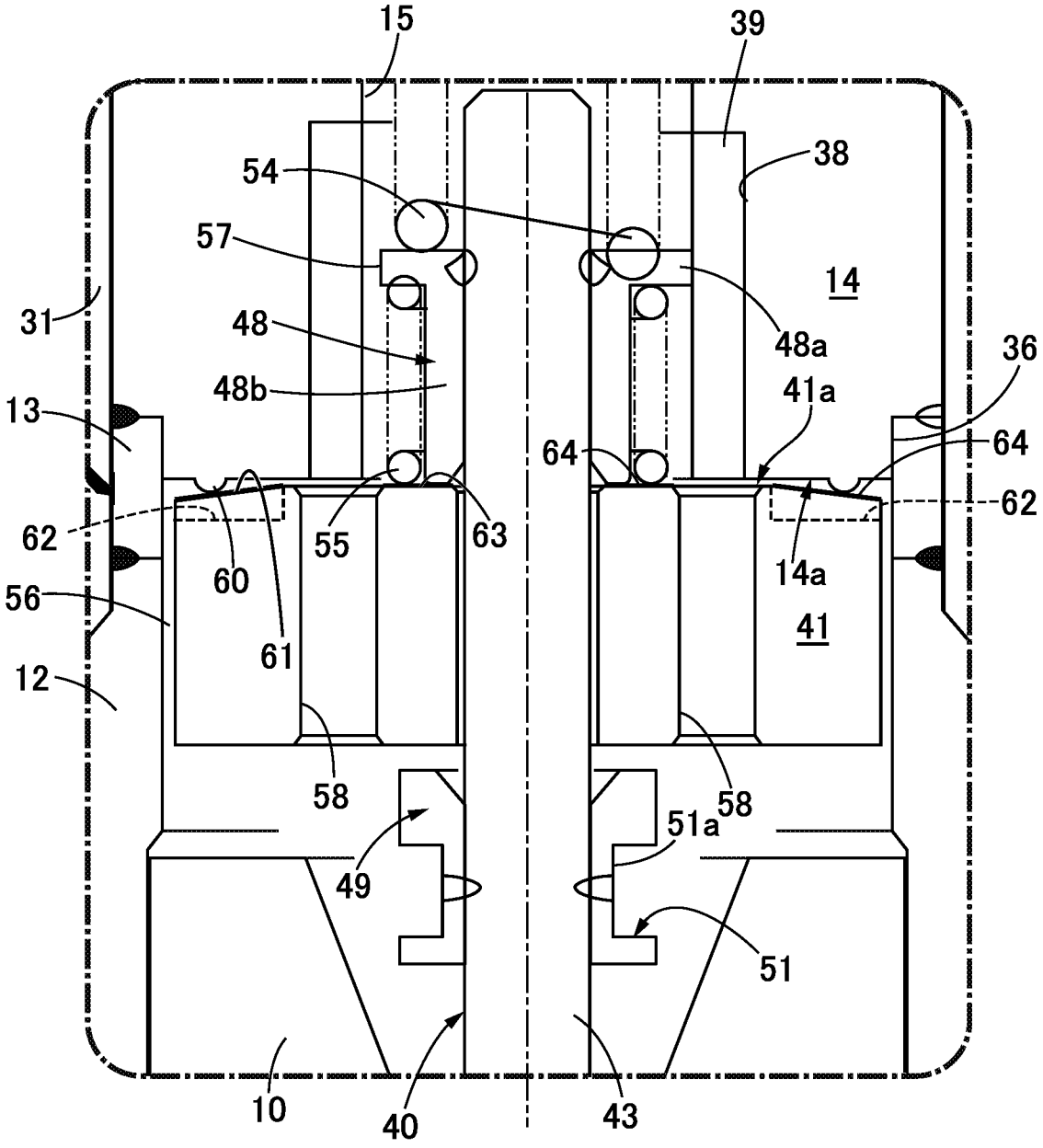
FIG. 3 is a view, corresponding to FIG. 2, showing a valve-open state of the fuel injection valve.

Referring in addition to FIG. 2 and FIG. 3, an annular recess 36 is formed in the outer periphery of the one end part of the fixed core 14, and the other end part of the non-magnetic cylindrical body 13 is fitted into and liquid-tightly welded to the annular recess 36 so that an outer peripheral face of the non-magnetic cylindrical body 13 is continuous with the fixed core 14.

Formed in an inner peripheral face of the one end part of the fixed core 14 is a fitting recess 38 opening on an attracting face 14*a* at the one end of the fixed core 14, and a cylindrical guide bush 39 is fixedly provided in the fitting recess 38 by press fitting so that one end part is flush or substantially flush with the attracting face 14*a* of the fixed core 14, an inner peripheral face of the guide bush 39 being continuous with the inner peripheral face of the fixed core 14.

One part of a valve body 40 and a movable core 41 are housed within the valve housing 9 extending from the valve seat member 11 to the non-magnetic cylindrical body 13. The valve body 40 is formed by a valve part 42 and a rod 43 connected to the valve part 42, the valve part 42 opening and closing the fuel discharge hole 28 in cooperation with the valve seat 27, the rod 43 extending to the interior of the guide bush 39. The valve part 42 is formed into a spherical shape so as to be in sliding contact within the valve seat member 11, the rod 43 being formed so as to have a smaller diameter than that of the valve part 42. An annular fuel flow path 44 is defined between the valve seat member 11 and the rod 43, and a plurality of flat parts 45 are formed on an outer peripheral face of the valve part 42 so as to define a fuel flow path between themselves and the valve seat member 11. The valve seat member 11 therefore allows fuel to pass through while guiding opening and closing of the valve body 40.

The movable core 41, which is disposed so as to oppose the attracting face 14*a* of the fixed core 14, is slidably and rotatably fitted around the rod 43. In order to restrict the slide stroke of the movable core 41 on the rod 43 so that it is constant, a valve open-side stopper 48 and a valve closed-side stopper 49 that are arranged so as to sandwich the movable core 41 are fixed to the rod 43. In this arrangement, the valve open-side stopper 48 is disposed so that it opposes and can abut against an attracted face 41*a*, opposing the fixed core 14, of the movable core 41, and the valve closed-side stopper 49 is disposed so that it opposes and can abut against the other end face, on the side opposite to the attracted face 41*a*, of the movable core 41.

When the valve body 40 is in a valve-closed state (see FIG. 2), the movable core 41 abuts against the valve closed-side stopper 49 and opposes the valve open-side stopper 48 across a gap therebetween that corresponds to the slide stroke, and this gap, that is, the slide stroke, is set so that it is smaller than a gap provided between the fixed core 14 and the movable core 41 in a state in which it abuts against the valve closed-side stopper 49. The timing is therefore such that when the fixed core 14 attracts the movable core 41 in response to energization of the coil 32, the movable core 41 first abuts against the valve open-side stopper 48 and then is attracted by the fixed core 14.

The valve-open side stopper 48 is formed from a flange portion 48*a* slidably fitted into an inner peripheral face of the guide bush 39 and a cylindrical shaft portion 48*b* projecting from the flange portion 48*a* toward the movable core 41 side. An inner peripheral part of the flange portion 48*a* is secured to the rod 43 by welding, and the valve-open side stopper 48 is disposed so that part of the shaft portion 48*b* projects further toward the movable core 41 side than the attracting face 14*a* and one end face of the guide bush 39 when the valve body 40 is at a valve-closed position. On the other hand, an annular groove 51 is formed in the outer periphery of the valve-closed side stopper 49, and securing a groove bottom wall of the annular groove 51 to the rod 43 by welding integrates the valve-closed side stopper 49 with the rod 43.

The guide bush 39 and the valve-open side stopper 48 are formed from a non-magnetic or weakly magnetic material having higher hardness than that of the fixed core 14, for example martensitic stainless steel, and have substantially equal hardness.

Referring again to FIG. 1, a pipe-shaped retainer 53 is fitted into and fixed by swaging to the hollow part 15 of the fixed core 14, and a valve spring 54 is provided in a compressed state between the retainer 53 and the flange portion 48*a* of the valve-open side stopper 48, the valve spring 54 urging the valve body 40 in a direction in which it is seated on the valve seat 27, that is, the valve-closing direction.

Furthermore, an auxiliary spring 55 surrounding the shaft portion 48*b* of the valve-open side stopper 48 is provided in a compressed state between the flange portion 48*a* of the valve-open side stopper 48 and the movable core 41. This auxiliary spring 55 has a set load that is smaller than the set load of the valve spring 54 and exhibits a spring force that urges the movable core 41 toward the side on which it moves away from the valve-open side stopper 48 and abuts against the valve-closed side stopper 49.

The other end part of the rod 43 projects from the flange portion 48*a* of the valve-open side stopper 48 and is fitted into an inner peripheral face of a movable end part of the valve spring 54, thus playing a role in positioning the valve spring 54. The shaft portion 48*b* of the valve-open side stopper 48 is fitted into an inner peripheral face of the auxiliary spring 55 to thus play a role in positioning the auxiliary spring 55.

An annular gap 56 is ensured between the outer peripheral face of the movable core 41 and inner peripheral faces of the magnetic cylindrical body 12 and non-magnetic cylindrical body 13. A flat part 57 is provided at a plurality of locations of the outer periphery of the flange portion 48*a* of the valve-open side stopper 48, the flat part 57 defining a fuel flow path between itself and the inner peripheral face of the guide bush 39, and a plurality of fuel through holes 58 that are arranged around the rod 43 are provided in the movable core 41.

In FIG. 2 and FIG. 3, formed on the attracting face 14*a* of the fixed core 14 is an annular rib 60 that has an arc-shaped longitudinal section and is concentric with the fixed core 14. The annular rib 60 has a semicircular longitudinal section in the illustrated example.

On the other hand, part of the attracted face 41*a* of the movable core 41, which opposes the attracting face 14*a* of the fixed core 14, is formed as a taper face 61 that is inclined downward in going outward in the radial direction of the movable core 41 and is concentric with the movable core 41. The taper face 61 can engage with the annular rib 60.

Formed on the attracted face 41*a* are a plurality of cutout recess parts 62 that divide the taper face 61 into a plurality of sections (desirably three sections as in the illustrated example) arranged at equal intervals along the peripheral direction of the movable core 41. In the illustrated example, a width a, along the peripheral direction of the movable core 41, of the taper face 61 of each section is set so as to be sufficiently smaller than a width b, along the peripheral direction of the movable core 41, of each recess part 62.

Figure 4:
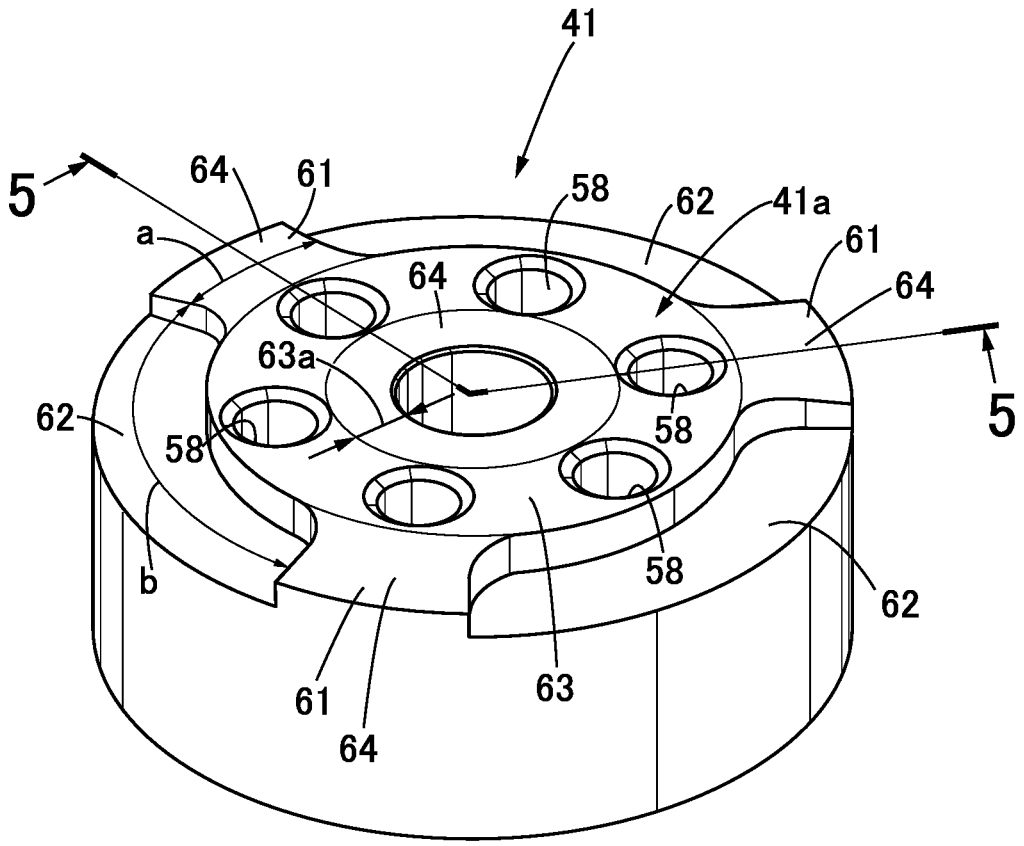
FIG. 4 is a perspective view of a movable core of the fuel injection valve.
Figure 5:
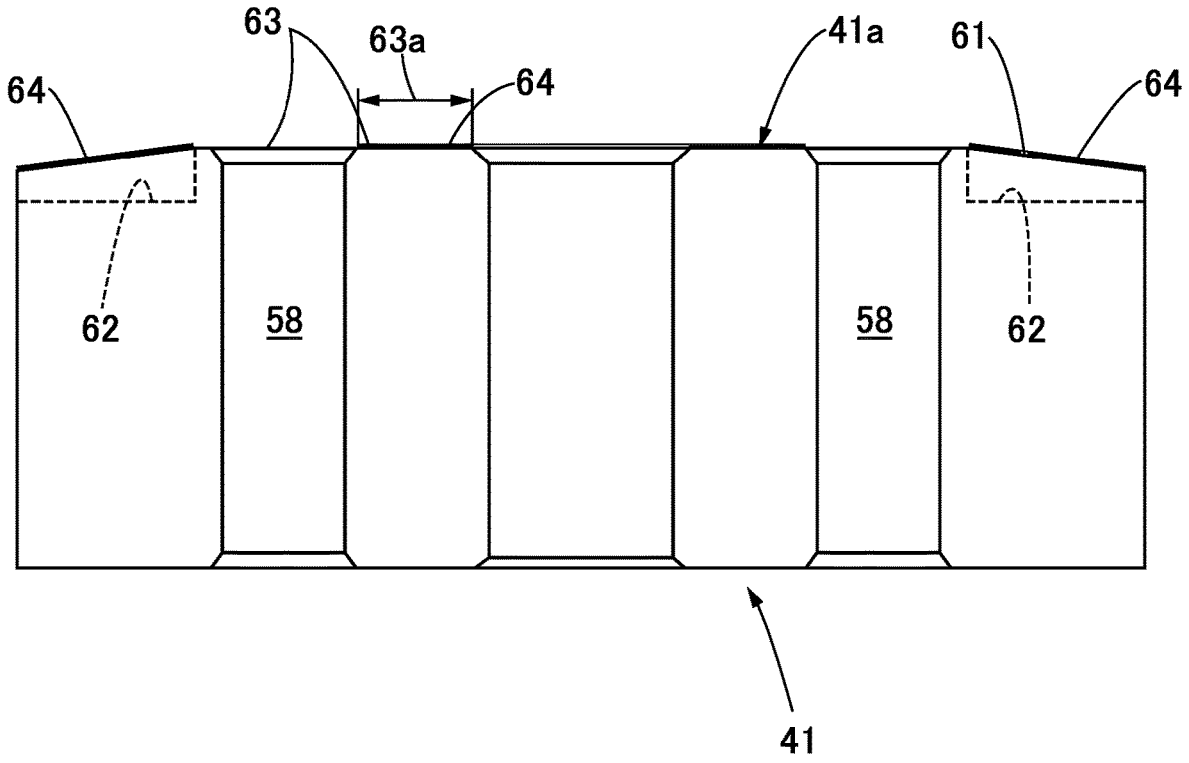
FIG. 5 is an enlarged sectional view along line 5-5 in FIG. 4.

In FIG. 4 and FIG. 5, a flat face 63 that is surrounded by the taper face 61 is provided on the attracted face 41*a* of the movable core 41, and the plurality of fuel through holes 58 are bored in the movable core 41 via the flat face 63 outside a region 63*a* that can abut against the valve open-side stopper 48. A plating layer (for example, a nickel-chrome plating layer) 64 that is harder than the movable core 41 is formed on the taper face 61 and the region 63*a*, which abuts against the valve-open stopper 48, of the flat face 63.

The operation of the embodiment is now explained.

In the electromagnetic fuel injection valve 8, when the coil 32 is in a non-energized state, the valve body 40 is pushed by the set load of the valve spring 54 and is made to be seated on the valve seat 27 to thus close the fuel discharge hole 28. That is, as shown in FIG. 2, in the valve-closed state, the movable core 41 is retained in a state in which it is made to abut against the valve-closed side stopper 49 by the set load of the auxiliary spring 55, thus maintaining a predetermined gap from the fixed core 14.

When the coil 32 is energized in such a valve-closed state, since the magnetic force generated between the fixed core 14 and the movable core 41 attracts the movable core 41 to the fixed core 14, it first slides upward on the rod 43 while compressing the auxiliary spring 55 and abuts against the valve-open side stopper 48. That is, since at a time of initial movement the movable core 41 slides while compressing the auxiliary spring 55, which has a smaller set load than that of the valve spring 54, when it experiences an attractive force from the fixed core 14 it moves smoothly upward and abuts against the valve-open side stopper 48 while accelerating.

The movable core 41 then smoothly moves further upward against the set load of the valve spring 54 while being accompanied by the valve open-side stopper 48, and is attracted by the attracting face 14*a* of the movable core 41.

Since the valve open-side stopper 48 thus moving upward together with the movable core 41 is fixed to the rod 43 of the valve body 40, it is possible to make the valve part 42 be detached from the valve seat 27 and attain a valve-open state. When the valve body 40 is opened, fuel that has been fed under pressure from a fuel pump, which is not illustrated, to the fuel supply tube 16 passes in sequence through the interior of the pipe-shaped retainer 53, the hollow part 15 of the fixed core 14, a fuel flow path around the valve open-side stopper 48, the plurality of fuel through holes 58 of the movable core 41, the interior of the valve housing 9, and a fuel flow path around the valve part 42, and is injected directly from the fuel injection hole 28 into the combustion chamber 6 of the internal combustion engine E.

When the fixed core 14 attracts the movable core 41 and the taper face 61 engages with the annular rib 60 with an impact, the valve body 40, which is formed from the valve part 42 and the rod 43, could overshoot due to its inertia, and in this case due to the valve closed-side stopper 49, which is integral with the valve body 40, colliding with the movable core 41, the overshoot is stopped. During this process, since the valve-open side stopper 48 increases the compressive deformation of the valve spring 54 while moving away from the movable core 41 by an amount corresponding to the overshoot of the valve body 40, overshooting of the valve body 40 is also suppressed by means of the repulsive force of the valve spring 54.

When the overshooting stops, the valve-open side stopper 48 is returned by means of the repulsive force of the valve spring 54 to a position at which it abuts against the movable core 41, which is attracted by the fixed core 14, and the valve body 40 is retained at a predetermined valve-open position. In this arrangement, since the set load of the auxiliary spring 55 is set smaller than the set load of the valve spring 54, which urges the valve body 40 in the valve-closing direction, when the coil 32 is energized the auxiliary spring 55 does not interfere with attraction of the movable core 41 by the fixed core 14 and abutment of the valve-open side stopper 48 against the movable core 41 by means of the valve spring 54, and does not inhibit opening of the valve body 40 to the predetermined position.

In this way, since in the process of opening of the valve body 40, the impact force that the movable core 41 applies to the fixed core 14 can be divided into an impact force when only the movable core 41 first abuts against the fixed core 14 and an impact force when the valve-closed side stopper 49 subsequently abuts against the movable core 41, each of the collision energies is relatively small, and it is possible to prevent wear of the parts via which the fixed core 14 and the movable core 41 abut against each other and to suppress the collision noise to a low level. Moreover, since when the valve-closed side stopper 49 abuts against the movable core 41 the valve spring 54 is deformed by a larger amount than the amount of compressive deformation when the valve opens normally, the valve spring 54 absorbs the collision energy of the valve-closed side stopper 49 against the movable core 41, thus alleviating the impact force. When energization of the coil 32 is subsequently cut off, since the valve-open side stopper 48 is pushed by means of the repulsive force of the valve spring 54, the valve-open side stopper 48 moves toward the valve seat 27 side together with the movable core 41 and the valve body 40, thus making the valve part 42 be seated on the valve seat 27 and stopping fuel injection from the fuel injection hole 28.

When the valve body 40 is seated on the valve seat 27 for the first time, it could rebound due to the seating impact, but since due to the movable core 41, which descends after a delay, abutting against the valve-closed side stopper 49 fixed to the valve body 40, said rebound can be minimized.

If rebound of the valve body 40 is suppressed, the valve body 40 is retained in a valve-closed state by means of the repulsive force of the valve spring 54 to thus suspend fuel injection, and the movable core 41 is held in a state in which it is made to abut against the valve-closed side stopper 49 by means of the repulsive force of the auxiliary spring 55.

As described above, during the process of closing the valve body 40, since the impact force that the valve body 40 applies to the valve seat 27 can be divided into the impact force when only the valve body 40 is first seated on the valve seat 27 and the impact force when the movable core 41 subsequently collides with the valve-closed side stopper 49, each of the collision energies is relatively small. Furthermore, when the valve body 40 is seated on the valve seat 27 for the first time, it rebounds due to the seating impact and is subsequently seated on the valve seat 27 again and delivers an impact, but since the valve-closing stroke after the rebound of the valve body 40 is much smaller than the valve-closing stroke from the usual valve-open position of the valve body 40, the impact force acting on the valve seat 27 is very small. This enables wear of the parts where the valve part 42 and the valve seat 27 seat against each other to be prevented and the seating noise to be suppressed.

As is clearly shown in FIG. 4, when the coil 32 is energized, that is, when the fixed core 14 is attracting the movable core 41, the taper face 61 on the attracted face 41*a* is strongly pushed against and engaged with the annular rib 60 on the attracting face 14*a* by virtue of the attractive force. In this arrangement, since the annular rib 60 is concentric with the fixed core 14 and the taper face 61 is concentric with the movable core 41, due to a self-centering action caused between the annular rib 60 and the taper face 61 a centering force is applied from the fixed core 14 to the movable core 41, thus immediately retaining the movable core 41 at a position in which it is coaxial with the fixed core 14. Therefore, even if the movable core 41 is disturbed due to the sliding gap between itself and the rod 43, the disturbance can immediately be suppressed, thus enhancing the valve-opening responsiveness of the valve body 40 and enabling the valve body 40 to be retained in a proper valve opening attitude without tilting.

Furthermore, since the taper face 61 of the movable core 41, which engages with the annular rib 60 of the fixed core 14, is divided into a plurality of sections by means of the plurality of recess parts 62, a fuel oil film present in the engaged part between the annular rib 60 and the taper face 61 is sectioned at a plurality of locations along the peripheral direction of the movable core 41. This enables a sticking phenomenon of the engaged part caused by the fuel oil film to be suppressed, and it is therefore possible to make the movable core 41 move away immediately from the fixed core 14 when energization of the coil 32 is cut off, that is, a delay in the movable core 41 moving away from the fixed core 14 can be solved, the valve-closing responsiveness can be improved, and consequently this can contribute to an improvement in the combustion efficiency of the internal combustion engine.

In particular, as in the illustrated example, when the width a, along the peripheral direction of the movable core 41, of the taper face 61 of each section is set so as to be sufficiently smaller than the width b, along the peripheral direction of the movable core 41, of each recess part 62, the region forming a fuel oil film present in the engaged part between the annular rib 60 and the taper face 61 is greatly reduced, and it is possible to suppress more effectively the sticking phenomenon of the engaged part due to the fuel oil film.

When the taper face 61 is divided into three sections arranged at equal intervals in the peripheral direction of the movable core 41 by means of the three recess parts 62, since the taper face 61 is engaged with the annular rib 60 in a stable three-point support state, it is possible to further stabilize the self-centering action between the annular rib 60 and the taper face 61.

Furthermore, due to the taper face 61 being divided into a plurality of sections, the area via which the annular rib 60 and the taper face 61 are engaged is reduced. This decreases the residual magnetism between the fixed core 14 and the movable core 41 when energization of the coil 32 is cut off, thus further improving the valve-closing responsiveness.

Moreover, the flat face 63, which is surrounded by the taper face 61 and can abut against the valve open-side stopper 48, is provided on the attracted face 41*a* of the movable core 41, the plating layer 64, which is harder than the movable core 41, is formed on the flat face 63 and the taper face 61, the flat face 63 and the taper face 61 therefore have high hardness, and it is thereby possible to prevent as much as possible wear of the movable core 41 caused by abutment against the valve open-side stopper 48 and the annular rib 60, thus contributing to an improvement in the durability of the electromagnetic fuel injection valve 8.

An embodiment of the present invention is explained above, but the present invention is not limited to the above embodiment and may be modified in a variety of ways as long as the modifications do not depart from the gist of the present invention.

For example, the annular rib 60 as the annular projection can be replaced by an arrangement in which a plurality of projections separated from each other are placed into a ring shape. The longitudinal-sectional shape of the annular rib 60 can be a polygon having its corner part chamfered, but is desirably an arc shape in order to facilitate the self-centering action. Furthermore, the hard plating layer 64 can also be continuously formed on the taper face 61 and the flat face 63.

What is claimed is:

1. An electromagnetic fuel injection valve comprising a valve housing that has a valve seat in one end part thereof, a hollow fixed core that is connected to another end of the valve housing, a coil that is disposed on an outer periphery of the fixed core, a valve body that is formed by a valve part and a rod connected to the valve part that operates in cooperation with the valve seat, a movable core that is fitted around an outer periphery of the rod while making an attracted face of the movable core oppose an attracting face of the fixed core within the valve housing, a valve open-side stopper that is fixed to the rod and is pushed by the movable core so as to open the valve body when the movable core is attracted by the fixed core due to energization of the coil, a valve closed-side stopper that is fixed to the rod at a position closer to the valve seat side than the valve open-side stopper, a valve spring that urges the valve body in a valve-closing direction, and an auxiliary spring that exhibits a spring force to move the movable core away from the valve open-side stopper and make the movable core abut against the valve closed-side stopper when the coil is unenergized, an annular projection that is concentric with the fixed core being formed on the attracting face of the fixed core, and a taper face being formed on the attracted face of the movable core, the taper face being inclined downward in going toward a radially outward direction of the movable core, being coaxial with the movable core, and engaging with the annular projection when the movable core is attracted by the fixed core, wherein a plurality of recess parts are provided in the attracted face, the plurality of recess parts dividing the taper face into a plurality of sections along a peripheral direction of the movable core.

2. The electromagnetic fuel injection valve according to claim 1, wherein three of the recess parts are set so as to divide the taper face into three sections that are arranged at equal intervals along the peripheral direction of the movable core.

3. The electromagnetic fuel injection valve according to claim 1, wherein a flat face that is surrounded by the taper face and can abut against the valve open-side stopper is provided on the attracted face of the movable core, and the flat face and the taper face are covered by a plating layer that is harder than the movable core.

4. The electromagnetic fuel injection valve according to claim 2, wherein a flat face that is surrounded by the taper face and can abut against the valve open-side stopper is provided on the attracted face of the movable core, and the flat face and the taper face are covered by a plating layer that is harder than the movable core.

* * * * *